US005692665A

United States Patent [19]

Lee

[11] Patent Number: 5,692,665

[45] Date of Patent: Dec. 2, 1997

[54] STAPLE CONFINER IN A STAPLER

[75] Inventor: Yun-Chung Lee, Taipei Hsien, Taiwan

[73] Assignee: De Poan Pneumatic Corporation, Taipei Hsien, Taiwan

[21] Appl. No.: 611,050

[22] Filed: Mar. 5, 1996

[51] Int. Cl.[6] ..... B25C 5/06

[52] U.S. Cl. ..... 227/109; 227/119

[58] Field of Search ..... 227/109, 119, 227/129, 130, 131

[56] References Cited

U.S. PATENT DOCUMENTS 3,720,364 3/1973 Maestri ..... 227/109
4,375,867 3/1983 Novak et al. ..... 227/109
5,180,091 1/1993 Ota ..... 227/120 X
5,522,533 6/1996 Mukoyama et al. ..... 227/109

*Primary Examiner*—Joseph J. Hail, III
*Assistant Examiner*—Jay A. Stelacone
*Attorney, Agent, or Firm*—Pro-Techtor International

[57] ABSTRACT

This invention relates to a staple confiner in a stapler using all kinds of U-shaped staples of different sizes. It comprises: An upper support, a lower support, the contact surface between the upper and the lower support having a guiding groove, into which the staples inside the magazine can be inserted to be ejected; two confining elements, which are mounted on a hinge on the upper support, to guide all kinds of U-shaped staples of different sizes; and a flexible element, which presses from above on the confining elements, such that the front ends of the confining elements normally press down on the lower part of the guiding groove.

5 Claims, 11 Drawing Sheets

STAPLE CONFINER IN A STAPLER

TECHNICAL FIELD

This invention relates to a kind of staple confiner in a stapler, especially for both using U-shaped staples and straight nails.

BACKGROUND ART

Conventional staplers can generally be classified into those using straight nails and those using U-shaped staples. The structure of these two kinds of staplers is different, and the two kinds of staples cannot be used interchangeably.

In conventional staplers for U-shaped staples, in turn, the size of the exit staple confiner must suit the width of the U-shaped staples. Then the staples can be exactly guided to be shot into the work object. Yet the design of that kind of staple confiner for U-shaped staples can only fit one kind of U-shaped staples, therefore conventional staplers for U-shaped staples can use U-shaped staples of only one size in a given stapler.

Later, a kind of stapler both using straight nails and U-shaped staples of various widths was disclosed (Taiwan Patent No. 82211011 "Improved Staple Holder in a Stapler"). This kind of stapler is provided with an magazine, which is loadable with straight nails and U-shaped staples of various sizes. Its exit staple confiner is also suitable for straight nails and U-shaped staples of various sizes. Therefore the effect of using straight nails and U-shaped staples of various sizes in a single stapler is attainable.

The structure of the staple confiner of the stapler is shown in FIG. 1 and 2. Included are: an upper support 1, a lower support 2, a confining element 3, and an staple ejecting strip 4. The lower support 2 is mounted on the top of the stapler's ammunition box 5, its upper side is fastened to the upper support 1. A guiding groove 6 is vertically cut into the bottom of the upper support 1. When the upper support 1 is fixed to the top of the lower support 2, the guiding groove 6 and the top of the lower support 2 combined will form a guiding hole for U-shaped staples of maximum width to be used in the stapler.

The staples in the stapler's ammunition box 5 can be led into the guiding grooves 6. After that, the staples are by means of the ejecting strip shot into the work object.

The confining element 3 has a body 7 as well as a first and a second extension part 8 and 9. The body 7 can be fastened onto the upper support 1, and the first and second extension parts 8 and 9 are arranged inside the guiding groove 6, parallel to the guiding groove 6. The first and the second extension parts 8 and 9 are elastic and bend downwards pressing against the top of the lower support 2.

That kind of stapler can use various kinds of different sized U-shaped staples. When using U-shaped staples of the largest width, both sides of the guiding groove 6 are employed for guiding. When using U-shaped staples of the second or the smallest width, one side of the U-shaped staples is guided by the left or right side of the guiding groove 6, the other side is guided by the first or the second extension part, so in this case the U-shaped staples can be guided as well and be shot smoothly into the work object.

That kind of stapler will reach the effect of using various kinds of different sized U-shaped staples. However, its confining element 3 is made by punching and bending of an elastic metal sheet and has very slim extension parts 8 and 9. When thermally treating them in the working process, the two extension parts 8 and 9 easily undergo deformation, and scarcely maintain their size precision. Thus a difficulty in making them arises.

Furthermore, the extension parts 8 and 9 are bendable flexible bodies, therefore they easily undergo deformation when ejecting staples, and their guiding stability is reduced.

Consequently, there is still some necessity of changing that stapler's staple confiner.

This inventor took these effects into account. After some active research, many years of experience in producing and selling related products and constant experiments and improvements this invention was finally developed.

The staple confiner of this invention includes an upper support and a lower support, which is connected to the stapler's magazine, the upper support being fastened to the lower support. On the contact surface of the upper and the lower support there is a guiding groove used to guide the U-shaped staples to be shot into the work object.

This invention is provided with a plurality of confining elements hinging on the upper support to replace the extension parts of conventional retaining elements. Their objective is to guide U-shaped staples of different widths together with the guiding groove.

The confining elements are unbendable stiff bodies. Their back ends hinge on the upper support, and their front ends are inclined downwards and press down on the bottom surface of the guiding groove.

Furthermore, there is a flexible element on the upper support exerting flexible force on the confining elements, leaving the front ends of the confining elements in a downward inclined state and allowing them to be pushed upwards when U-shaped staples are ejected.

When the width of the U-shaped staples used in the stapler is smaller than the width of the guiding groove, one side of the U-shaped staples will lean on one side of the guiding groove, and the other side will be guided by a confining element. So the stapler can use U-shaped staples narrower than the guiding groove.

The guiding effect of the confining elements is similar to the guiding effect of the extension parts of conventional confiners. However, since the confining elements are unbendable stiff bodies, they will provide stable guidance.

To link the confining elements to their support a hinge is used, so the confining system can be simplified to be a rod-like system. Therefore it is easy to make and will not easily bend and deform upon thermal treatment, its size will be easily controled and its precision will be enhanced.

The main objective of this invention consists in providing a simple structured, easily producible staple confiner in a stapler.

A further objective of this invention consists in providing a staple confiner in a stapler with a firm structure and better precision.

The technical methods, structural parts and their function in order to achieve these and other objectives will become clear from the following embodiments and suitable related drawings.

BEST MODE TO CARRY OUT THE INVENTION

Figure 1:
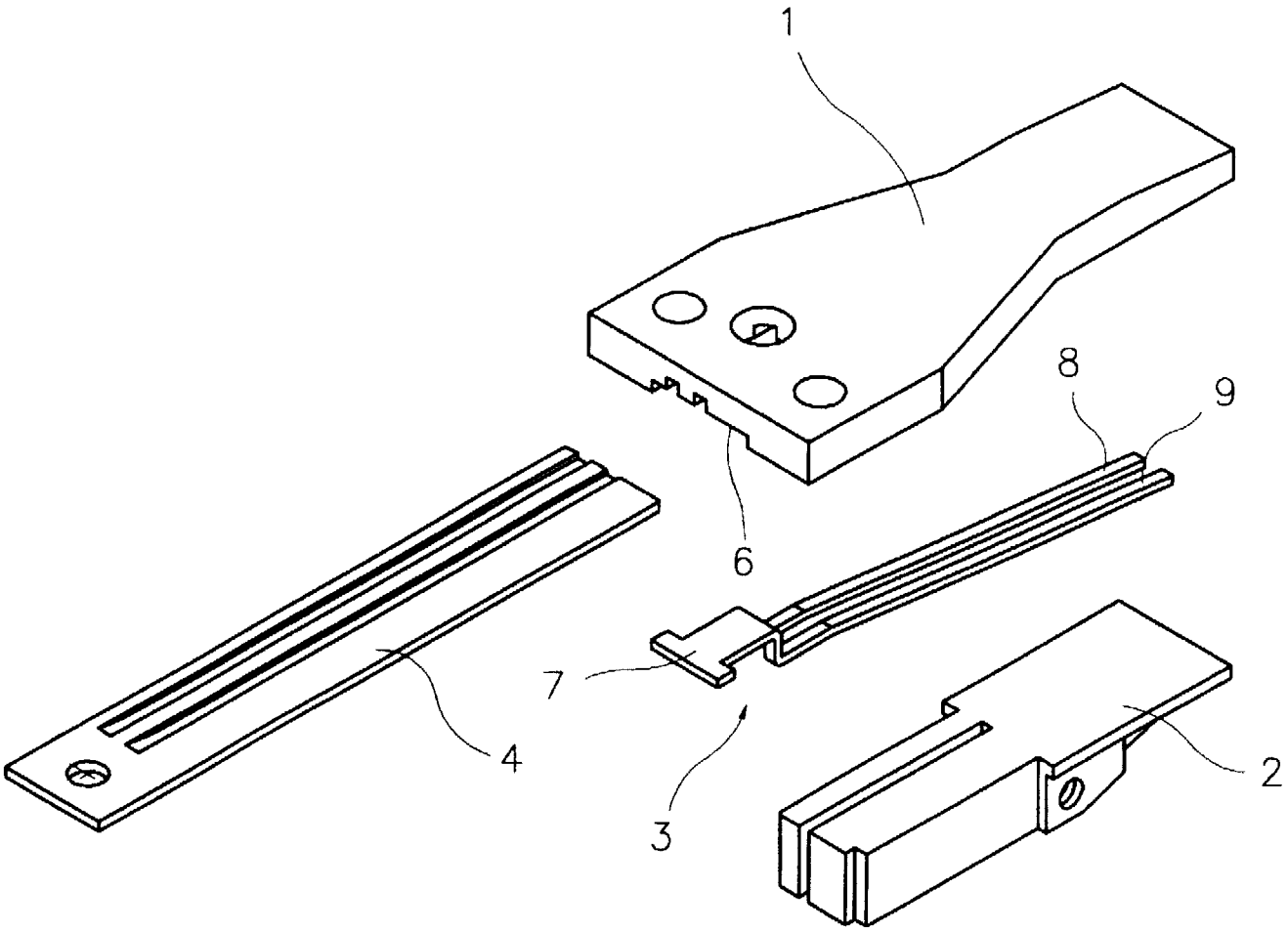
FIG. 1 is an exploded three-dimensional view of a kind of conventional staple confiner in a stapler.
Figure 2:
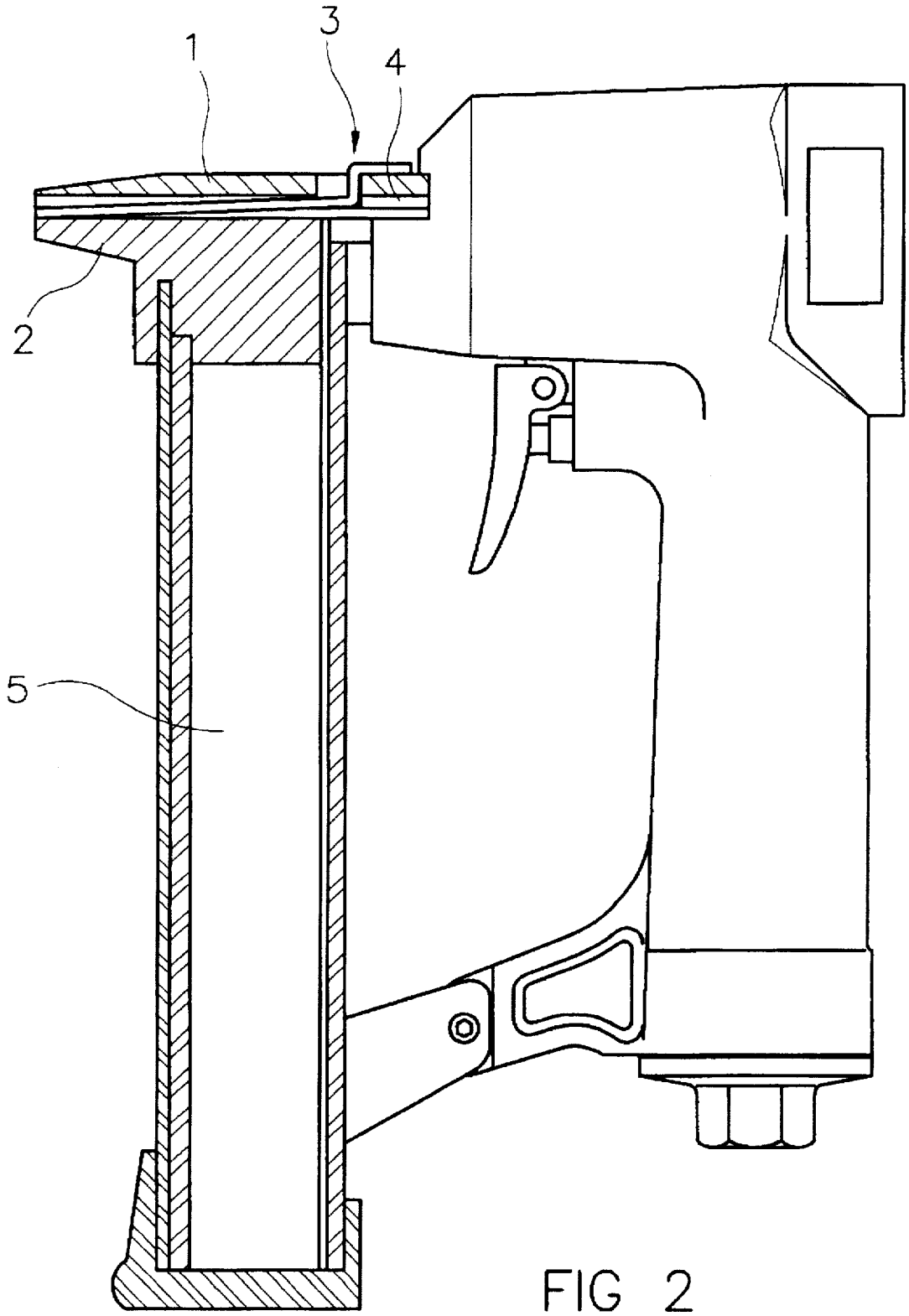
FIG. 2 is a sectional view of the staple confiner shown in FIG. 1, after installing on a stapler.
Figure 3:
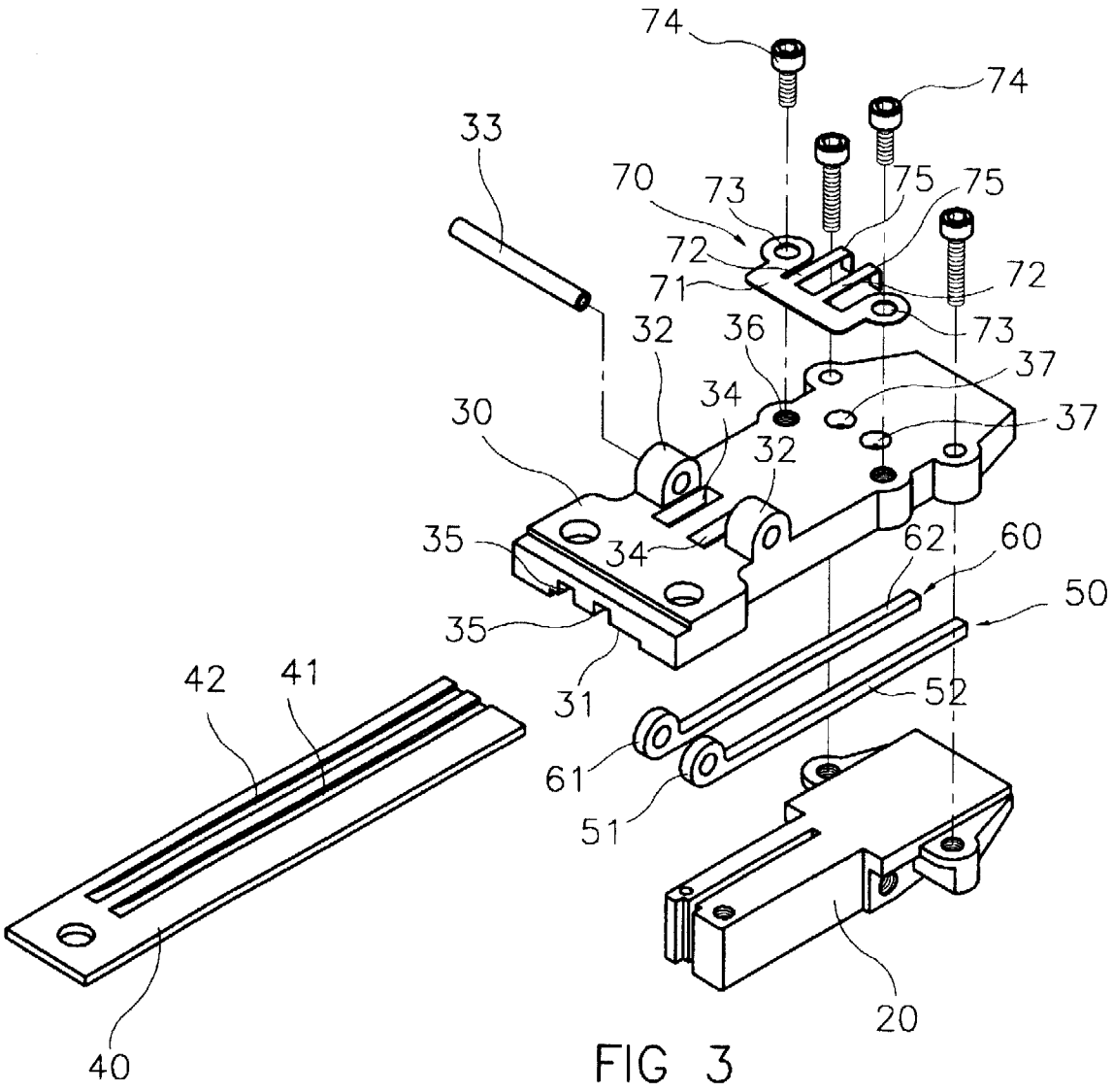
FIG. 3 is an exploded three-dimensional view of this invention's staple confiner.
Figure 4:
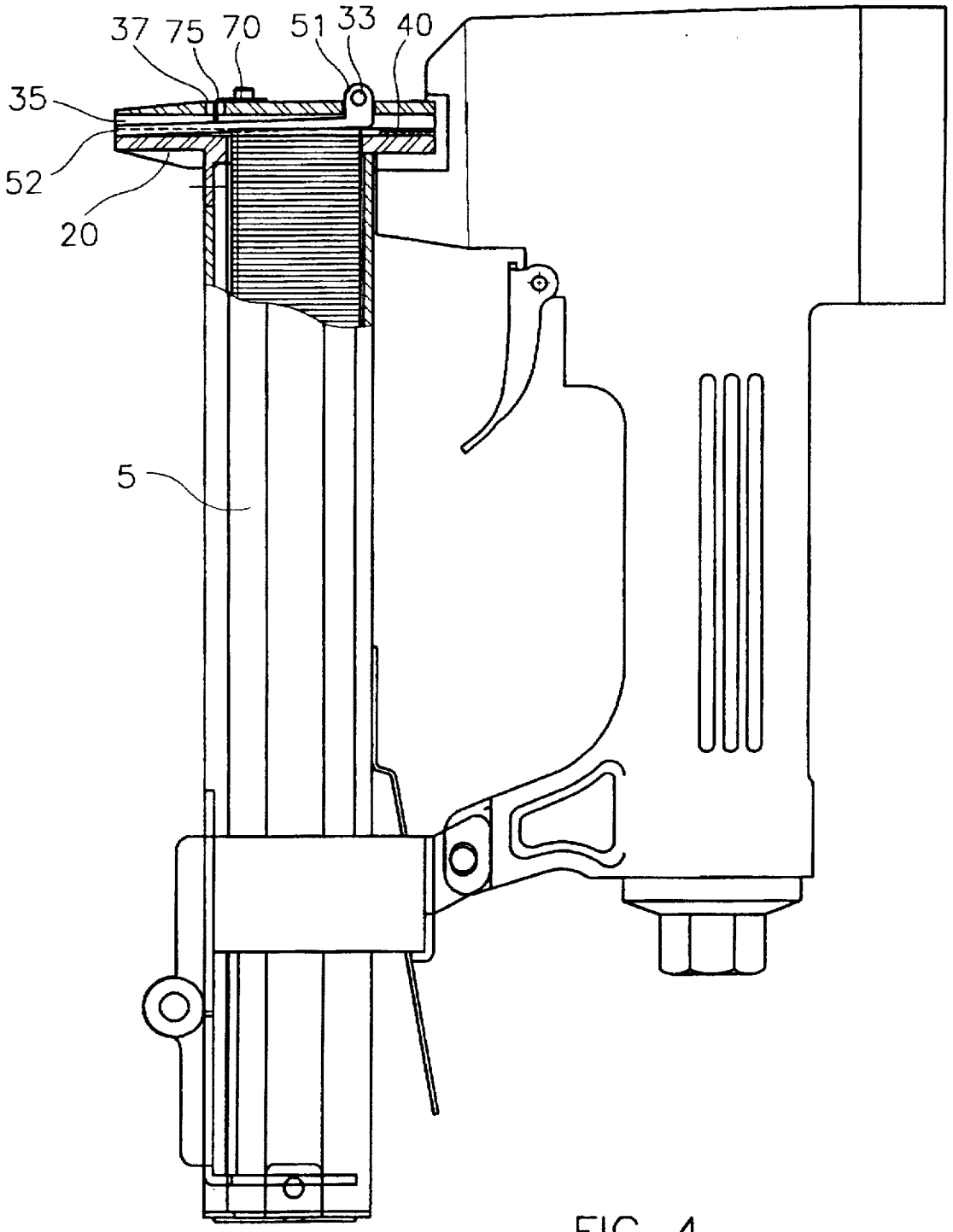
FIG. 4 is a sectional view of this invention's staple confiner installed on a stapler.

FIG. 3 and 4 show the structure of this invention's staple confiner. It comprises: A lower support 20, an upper support 30, a staple ejecting strip 40, a first and a second confining element 50 and 60, and a flexible element 70.

The structure of the lower support 20 and the structure of a conventional stapler's lower support are similar, so there is no need for a detailed description. The upper support 30 is fastened to the upper side of the lower support. Its bottom side is provided with a guiding groove 31 on the contact surface with the lower support. The lower side of the lower support 20 is connected to the magazine 5 of the stapler. The staples inside the magazine will be brought up to the lower support's 20 upper side and inserted into the guiding groove 31. The staple ejecting strip 40 is extendable into the guiding groove 31, such that the staples are pushed out through the guiding groove 31 and shot into the work object.

The upper support 30 has on its upper side two symmetrically attached hinge bearings 32 to provide a support for the first and second confining element 50 and 60. The first and second confining element 50 and 60 each have a hinge element 51 and 61. The hinge elements 51 and 61 are by means of a shaft 33 mountable on the hinge bearings 32. The upper support 30 has two holes 34, which are placed between the hinge bearings 32, corresponding to the position of the hinge elements 51 and 61 of the first and second confining element 50 and 60. Thereby the hinge elements 51 and 61 can extend through the upper support's 30 top plane to the guiding groove 31 in the upper support's bottom plane. To the lower end of each of the hinge elements 51 and 61 there is a guiding part 52 or 62, respectively. The two guiding parts 52 and 62, extend parallel to the guiding groove from the upper support at their back end into the opening of the guiding groove 31.

Figure 5:
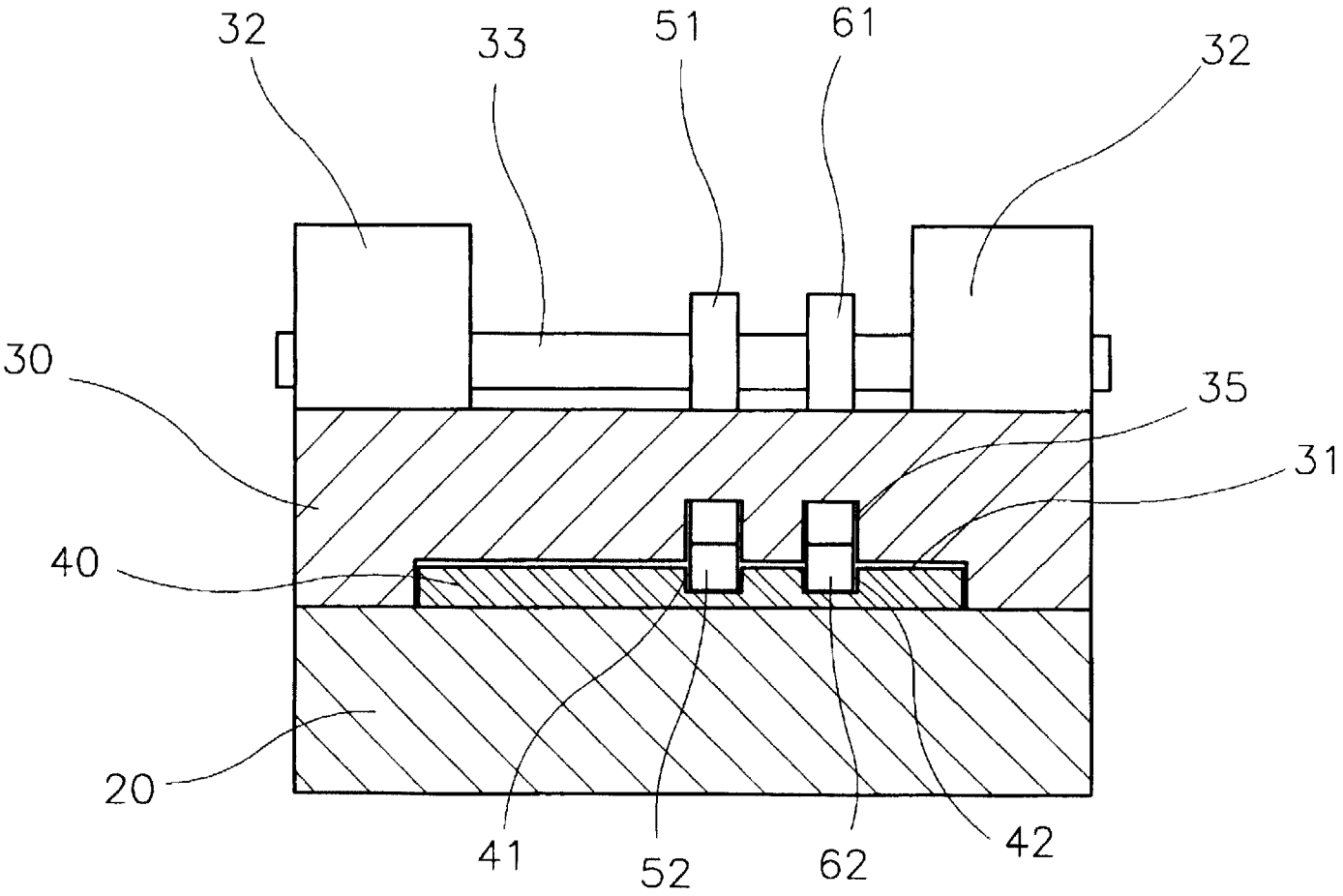
FIG. 5 is a sectional view to show the connection between this invention's confining element and the upper and lower support.

As shown in FIGS. 3, 4 and 5, the upper support's 30 guiding groove 31 on its top surface is provided with two accommodating grooves 35, which are placed corresponding to the two guiding parts 52 and 62. The size of the two accommodating grooves 35 fits the two guiding parts 52 and 62, so the two guiding parts 52′ and 62 can be accommodated.

As shown in FIGS. 3, 4 and 5, the back ends of the guiding parts 52 and 62 of the first and second confining element 50 and 60 are accommodated by the two accommodating grooves 35. Their front ends are in a normal state pressed from above by the flexible base element 70 and, being inclined downwards, in turn press down on the lower support's 20 top surface.

The flexible base element 70 is punched from a metal sheet and comprises a body 71 and two elastic strips 72. The body 71 has two holes 73, allowing two screws 74 to be stuck through to fix the body to the upper support 30 on two threaded holes 36. The elastic strips 72 extend from the body 71 forward. Their positioning corresponds to the positioning of the first and second confining element 50 and 60. On the front end they have a downward bent extension part 75 each. The two extension parts 75 pass through two holes 37 on the upper support 30 and press down on the guiding parts 52 and 62 of the first and second confining element 50 and 60, such that the front ends of the guiding parts 52 and 62 are in a state of being inclined downwards and are movable elastically up and down.

As shown in FIGS. 3 and 5, the thickness of the ejecting strip 40 is about equal to the depth of the guiding groove 31. On the top surface of the ejecting strip 40 there are the gliding grooves 41 and 42, whose positions match those of the first and second confining element 50 and 60. The function of the gliding grooves 41 and 42 is to allow the front tips of the guiding parts 52 and 62 of the first and second confining element 50 and 60 to enter the gliding grooves 41 and 42, when the ejecting strip 40 is pushed forward. So the front tips of the guiding parts 52 and 62 always stay inside the guiding groove 31.

Figure 6:
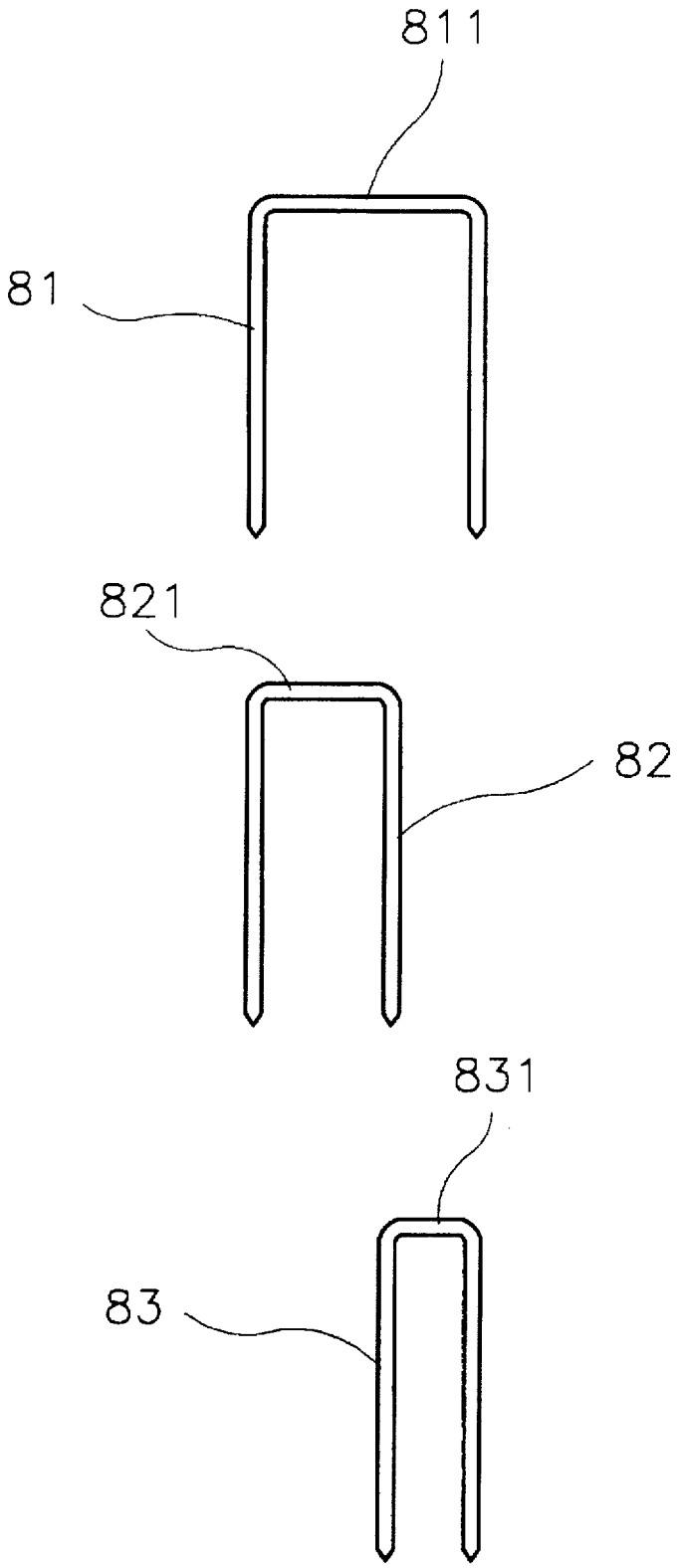
FIG. 6 is a planar view to show the U-shaped staples of all sizes used in this invention.

As shown in FIG. 6, the staples usable by this invention's staple confiner can be divided into the widest U-shaped staples 81, the second-widest U-shaped staples 82, and the narrowest U-shaped staples 83. The width of the widest U-shaped staples 81 is equal to the width of the guiding groove 31.

Figure 8:
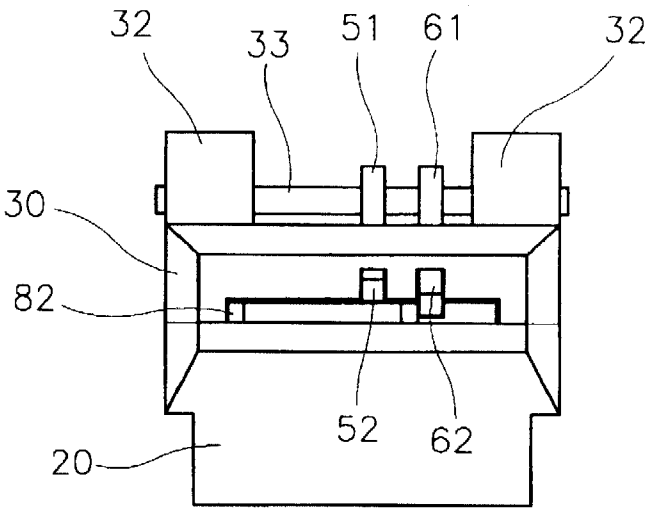
FIGS. 7 to 9 are diagrams of the movement of this invention's confining element as seen from the front side, to show the confiner's working while ejecting all kinds of U-shaped staples.
Figure 7:
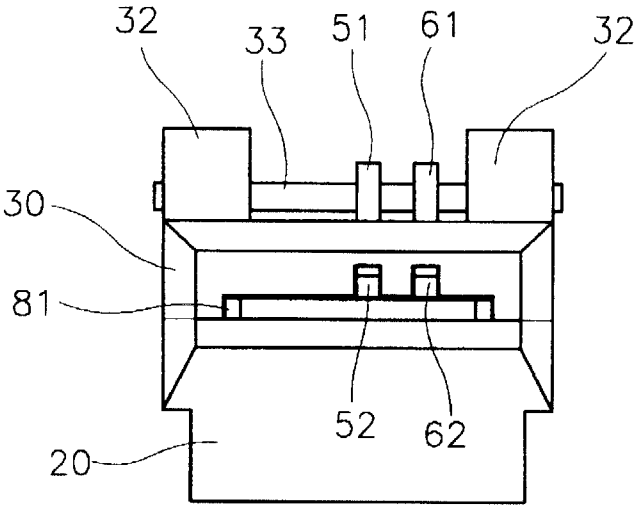
Figure 9:
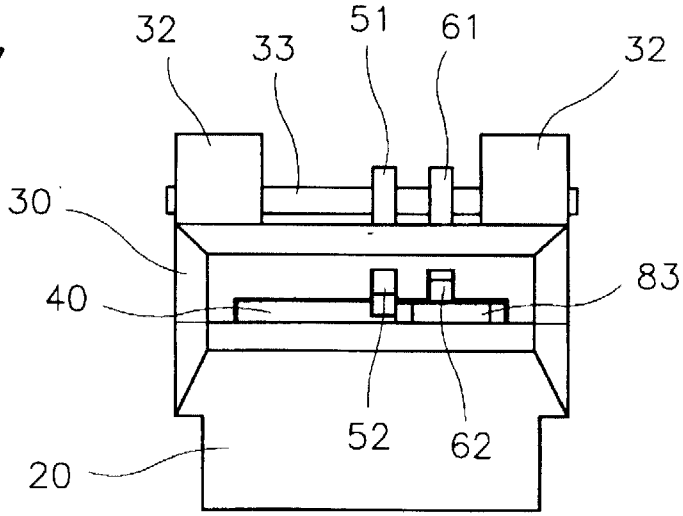

As shown in FIGS. 7, 8 and 9, concerning the working of this invention's staple confiner, when using the widest U-shaped staples 81, the U-shaped staples 81 use both sides of the guiding groove 31 as a guidance. When the shoulder part 811 of a U-shaped staple 81 passes the front tips of the guiding parts 52 and 62, The two guiding parts 52 and 62 will be pushed up and enter the accommodating grooves 35, so they will not interfere with the staple's movement.

As shown in FIGS. 8 and 9, the positions of the first and second confining element 50 and 60 correspond to the width of the other types of U-shaped staples 82 and 83 used by the stapler. The U-shaped staples 82 and 83 are respectively ejected along the left and the right side of the guiding groove 31. While being ejected, one side of a U-shaped staple 82 or 83 leans tightly on one side wall of the guiding groove 31. One of the first and second confining elements 50 and 60 is pushed up by the shoulder part 821 or 831 of the U-shaped staple, and the other confining element maintains contact with the respective other side of the U-shaped staple 82 or 83. Thereby, at ejection time one side of a U-shaped staple 82 or 83 is guided by the side wall of the guiding groove 31, the other side is guided by the first confining element 50 or the second confining element 60.

The main special feature of this invention's staple confiner consists in the first and second confining elements 50 and 60 employing a stiff design, being by a hinge connected to the upper support 30 and, by using the flexible element 70, being able to return automatically to their original position. This is different from conventional staplers of the same type that use staple confining elements made by punching and bending of an elastic metal sheet.

The biggest advantage is that the first and second confining elements 50 and 60 have a shape considerably simpler than that of the staple confining elements in conventional staplers of the same type. Therefore, their production is much simpler. They are not easily deformed upon thermal treatment, thus their size precision becomes higher. Furthermore, the first and second confining elements 50 and 60 are made of stiff material, so they do not easily deform at ejection time and thus provide stabler guidance.

Figure 10:
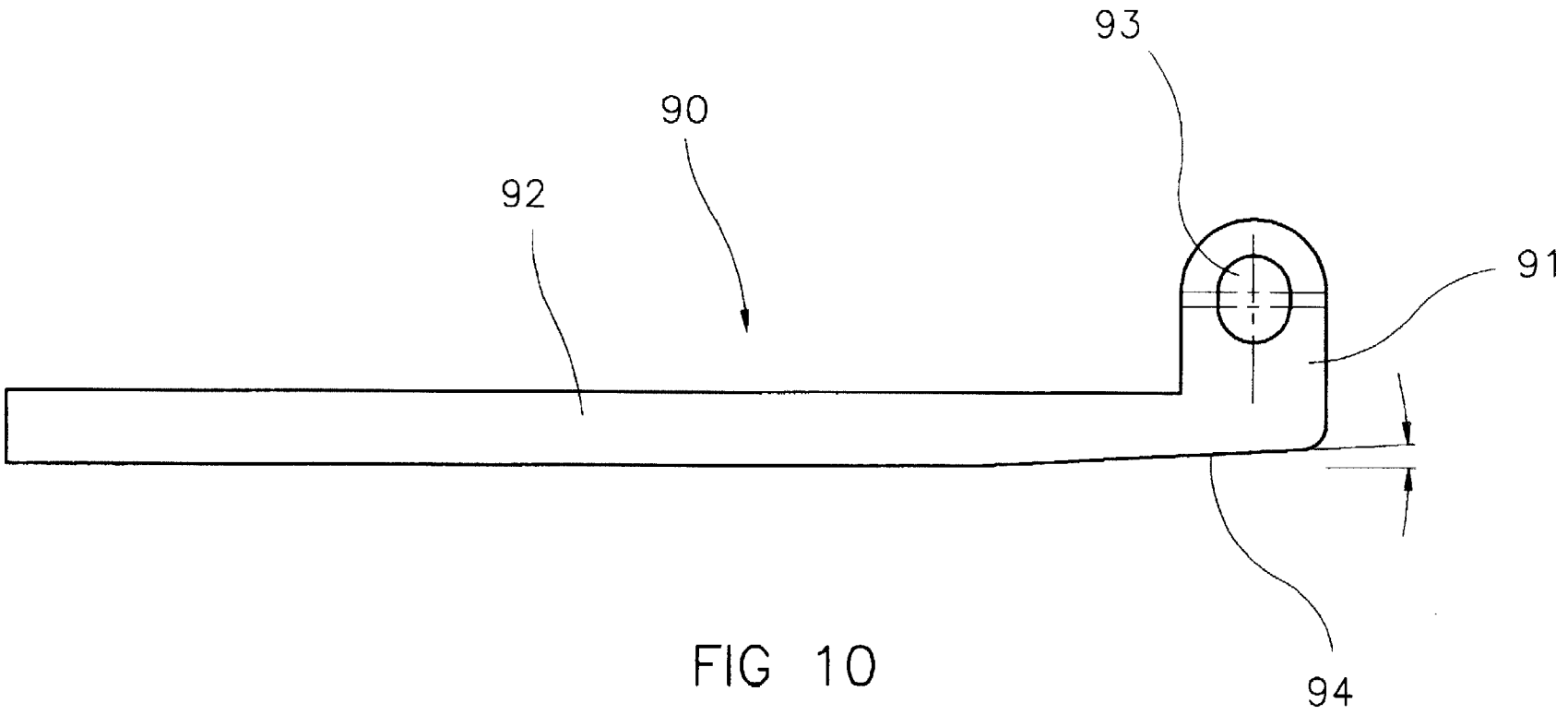
FIG. 10 is a planar view to show another variant of the confining element used in this invention.

This invention's first and second confining elements 50 and 60 have some design details, which may be varied to further the guiding effect. As shown in the embodiment in FIG. 10, a confining element 90 has a hinge part 91 and a guiding part 92. The hinge part 91 is provided with an oval-shaped elongated hole 93. The guiding part's 92 bottom side exhibits an inclination angle 94 at the end close to the hinge part 91.

Figure 11:
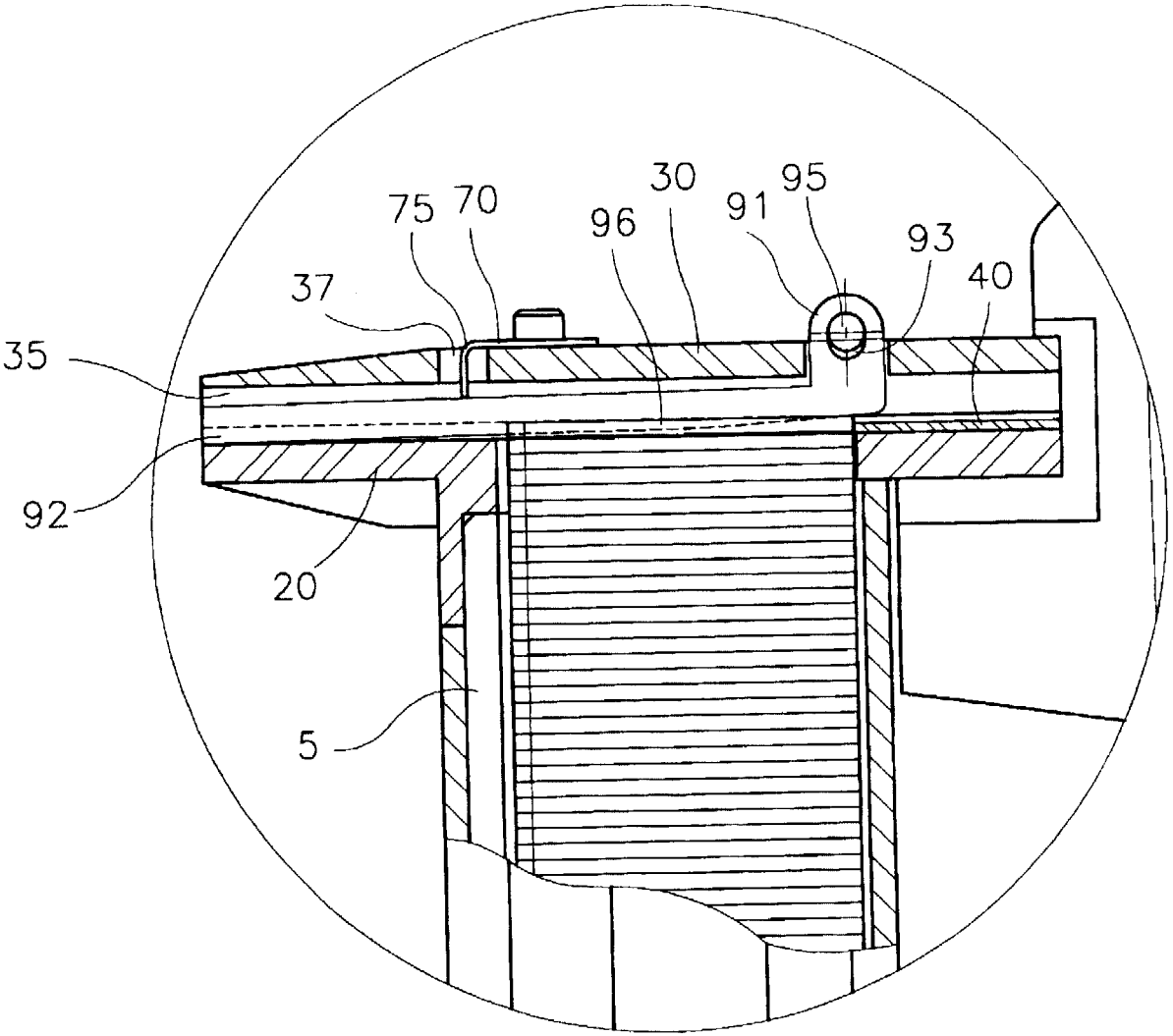
FIGS. 11 to 13 are diagrams of a movement in various states to show how the confining element shown in FIG. 10 moves while ejecting a staple.

As shown in FIG. 11, the confining element 90 uses a shaft 95 passing through the elongated hole 93 and to hinge on the hinge bearings 32. So the hinge part 91 around the shaft 95 is still movable a little up and down. When the stapler is in an idle state, the confining element 90 undergoes the flexible element's 70 downward pressure, and its back end stays in turn in a downward pressing state. At this time the shaft 95 touches the upper part of the elongated hole 93. In this state, the bottom side of the guiding part 92 lies almost horizontally on the top side of the lower support 20. So a U-shaped staple 96 in the guiding groove 31 is in contact with a maximum amount of the guiding part's 92 area, therefore the U-shaped staple is provided with stable guidance.

Figure 12:
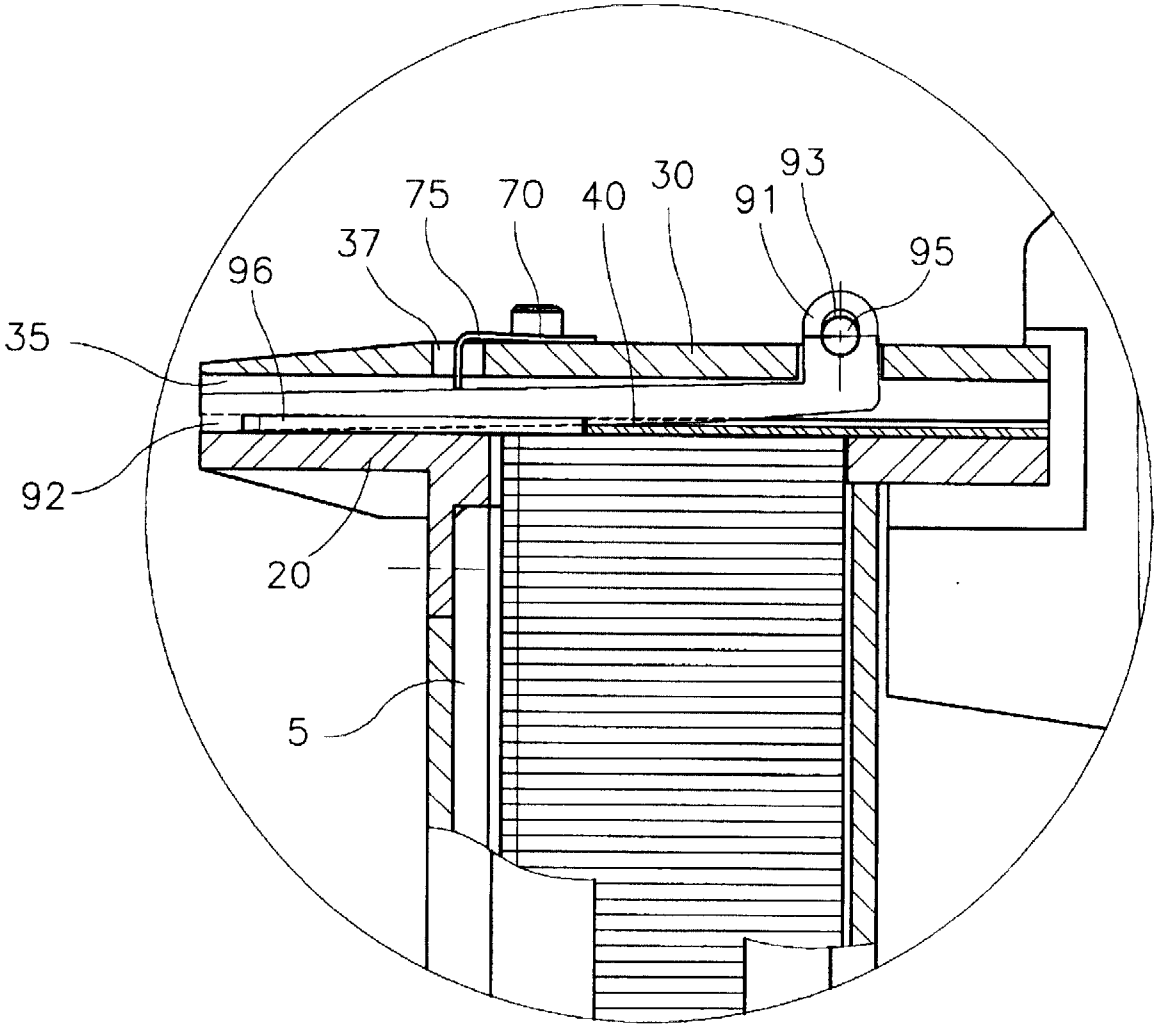
Figure 13:
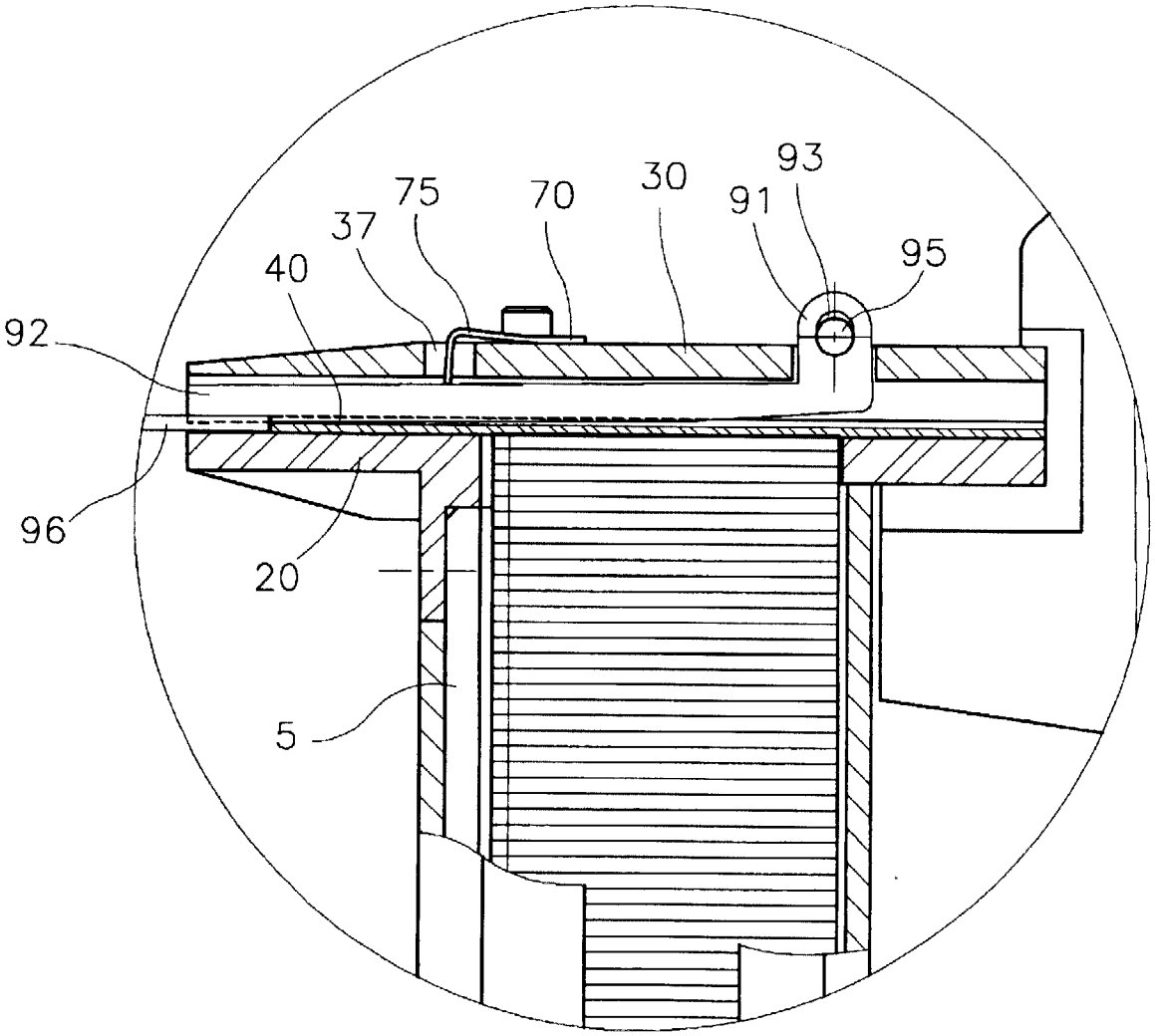

As shown in FIG. 12, when the ejecting strip 40 starts to eject a staple, the ejecting strip 40 will push up the back end of the confining element 90 first. At this time the shaft 95 touches the lower part of the elongated hole 93. the front end of the guiding part 92 still undergoes the flexible element's 70 downward pressure and is in contact with the top side of the lower support 20. By means of the inclination angle 94 of the bottom side of the guiding part's 92 back end the ejecting strip 40 can move smoothly under the guiding part's 92 bottom side.

As shown in FIG. 12, only when the ejecting strip 40 proceeds to the end of the guiding groove 31, the front end of the guiding part 92 will be pushed up by the ejecting strip 40 and be separated from the top side of the lower support 20.

The biggest advantage of this invention using this kind of design is that the back end of the guiding part 92 of the confining element 90 can stay as much as possible in contact with the top side of the lower support 20. So, when the staples just start to be ejected, the bottom side of the guiding part 92 lies almost horizontally on the top side of the lower support 20. Therefore the contact surface of the guiding part 92 with the staples 96 can be maximized, and a stabler guidance effect will be achieved.

What is claimed is:

1. A staple confiner of a stapler comprising:

a lower support connected to an upper end of a magazine of said stapler;

an upper support fastened to an upper side of said lower support;

a guiding groove formed on a lower surface of said upper support, staples inside said magazine being inserted into said guiding groove, said staples then being ejected through said guiding groove and into a work object by means of an ejecting element of said stapler;

a first and a second confining element, each said confining element extending from an upper portion of a back part of said guiding groove to a lower portion of a front part of said guiding groove, each said confining elements being pivotally affixed to said upper support;

a flexible element mounted on said upper support, said flexible element providing an elastic force onto said first and said second confining elements, such that said first and said second confining elements are inclined downward and press onto a lower surface of said guiding groove, two accommodating grooves on a top surface of said guiding groove accommodate said first and said second confining elements; wherein said confining elements divide a width of said guiding groove into a plurality of chambers, each said chamber having a different width to accommodate a plurality of sizes of staples differing in width as well as straight nails.

2. The staple confiner of a stapler as claimed in claim 1, wherein:

said first and second confining elements each are provided with a hinge part and a guiding part extending forward; and said staple confiner includes two aligned hinge bearings mounted on a top surface of said upper support, said hinge parts passing through said guiding groove of said upper support, said staple confiner further including two hinge bearings on said top surface of said upper support, said confining elements being mounted by means of a shaft hinging passing through said hinge bearings and said hinge parts.

3. The staple confiner of a stapler as claimed in claim 2, wherein:

said hinge parts of said first and said second confining elements each have a vertically elongated hole for said shaft to pass through, said vertically elongated hole allowing slight movement up and down of said first and second confining elements.

4. The staple confiner of a stapler as claimed in claim 3, wherein:

a bottom surface of a rear end of said guiding parts is angled.

5. The staple confiner of a stapler as claimed in claim 1, wherein:

said flexible element further includes a body mounted on said upper support; and two extension parts extending from said body and elastically pressing down on said first and said second confining elements.

* * * * *